US010637178B2

(12) United States Patent
Shinba et al.

(10) Patent No.: US 10,637,178 B2
(45) Date of Patent: Apr. 28, 2020

(54) CONNECTOR HOLDER

(71) Applicant: KYOCERA Document Solutions Inc., Osaka-shi, Osaka (JP)

(72) Inventors: Minoru Shinba, Osaka (JP); Yuichi Sugiyama, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/420,754

(22) Filed: May 23, 2019

(65) Prior Publication Data

US 2019/0363480 A1 Nov. 28, 2019

(30) Foreign Application Priority Data

May 24, 2018 (JP) ..... 2018-099272

(51) Int. Cl.

| | |
|---|---|
| ***H01R 13/518*** | (2006.01) |
| ***H01R 24/60*** | (2011.01) |
| ***H01R 13/04*** | (2006.01) |
| ***H01R 13/502*** | (2006.01) |
| ***H01R 13/42*** | (2006.01) |
| ***H01R 107/00*** | (2006.01) |

(52) U.S. Cl.

CPC ..... *H01R 13/518* (2013.01); *H01R 13/04* (2013.01); *H01R 13/42* (2013.01); *H01R 13/502* (2013.01); *H01R 24/60* (2013.01); *H01R 2107/00* (2013.01)

(58) Field of Classification Search

CPC ..... H01R 13/04; H01R 13/42; H01R 13/502; H01R 13/516; H01R 13/518; H01R 24/60; H01R 2107/00

See application file for complete search history.

(56) References Cited

U.S. PATENT DOCUMENTS

| | | | | |
|---|---|---|---|---|
| 4,964,817 A | 10/1990 | Kanai | | |
| 5,673,346 A * | 9/1997 | Iwano | G02B 6/3817 | 385/60 |
| 6,616,476 B1 * | 9/2003 | Moritz | H01R 4/2462 | 439/395 |
| 7,241,058 B2 * | 7/2007 | Takamatsu | G02B 6/3831 | 385/53 |

(Continued)

FOREIGN PATENT DOCUMENTS

| | | |
|---|---|---|
| JP | H02106688 U | 8/1990 |
| JP | 2014120483 A | 6/2014 |

*Primary Examiner* — Oscar C Jimenez

(74) *Attorney, Agent, or Firm* — Alleman Hall Creasman & Tuttle LLP

(57) ABSTRACT

A connector holder integrally holds a plurality of electric wire side connectors. The connector holder includes a plurality of holding portions which are formed in a lower surface side of the connector holder, and in which a plurality of wire-side ends of the plurality of electric wire side connectors are respectively fitted. The plurality of holding portions are arranged at intervals in a pin alignment direction in which a plurality of pins are aligned in each of the plurality of electric wire side connectors held by the plurality of holding portions. A part of an upper surface of the connector holder that is positioned between the plurality of holding portions is a pressed portion that is pressed so that the plurality of electric wire side connectors are inserted in a predetermined insertion direction. The pressed portion is formed as a plane perpendicular to the insertion direction.

4 Claims, 7 Drawing Sheets

(56) References Cited

U.S. PATENT DOCUMENTS

| | | | | |
|---|---|---|---|---|
| 7,911,778 | B2 * | 3/2011 | Merrow | G11B 19/042 312/223.1 |
| 8,052,458 | B2 * | 11/2011 | Rossman | H01R 13/6456 439/358 |
| 2002/0160656 | A1 * | 10/2002 | Nishita | G02B 6/3817 439/577 |
| 2003/0017724 | A1 * | 1/2003 | Tsuyama | B60R 1/07 439/13 |
| 2005/0124216 | A1 * | 6/2005 | Sagawa | H01R 13/4365 439/595 |
| 2011/0235977 | A1 * | 9/2011 | Yamada | H01R 13/621 385/76 |
| 2012/0302084 | A1 * | 11/2012 | Daugherty | H01R 13/639 439/352 |
| 2013/0040473 | A1 * | 2/2013 | Tanaka | B60L 3/0069 439/86 |
| 2019/0334285 | A1 * | 10/2019 | Shinba | H01R 13/639 |

* cited by examiner

CONNECTOR HOLDER

INCORPORATION BY REFERENCE

This application is based upon and claims the benefit of priority from the corresponding Japanese Patent Application No. 2018-099272 filed on May 24, 2018, the entire contents of which are incorporated herein by reference.

BACKGROUND

The present disclosure relates to a connector holder for integrally holding a plurality of connectors.

In an image forming apparatus such as a copier or a multifunction peripheral, many boards are included and a lot of electric wires are used to connect the boards with each other or connect the boards with other units. In general, a connection of a board and an electric wire(s) is realized by connecting a board side connector with an electric wire side connector. However, in recent years, the use of multipole connectors has been increasing, allowing a lot of electric wires to be connected at once.

In the multipolarization of the electric wire side connectors, it has been proposed that a connector holder uses a pair of connectors each having a line of contacts, to accept and hold a connector having two lines of contacts.

SUMMARY

A connector holder according to an aspect of the present disclosure integrally holds a plurality of electric wire side connectors. The connector holder includes a plurality of holding portions which are formed in a lower surface side of the connector holder, and in which a plurality of wire-side ends of the plurality of electric wire side connectors are respectively fitted. The plurality of holding portions are arranged at intervals in a pin alignment direction in which a plurality of pins are aligned in each of the plurality of electric wire side connectors held by the plurality of holding portions. A part of an upper surface of the connector holder that is positioned between the plurality of holding portions is a pressed portion that is pressed so that the plurality of electric wire side connectors are inserted in a predetermined insertion direction. The pressed portion is formed as a plane perpendicular to the insertion direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It is noted that in the following embodiments, common components are assigned the same reference signs, and description is omitted as appropriate.

First Embodiment

Figure 1:
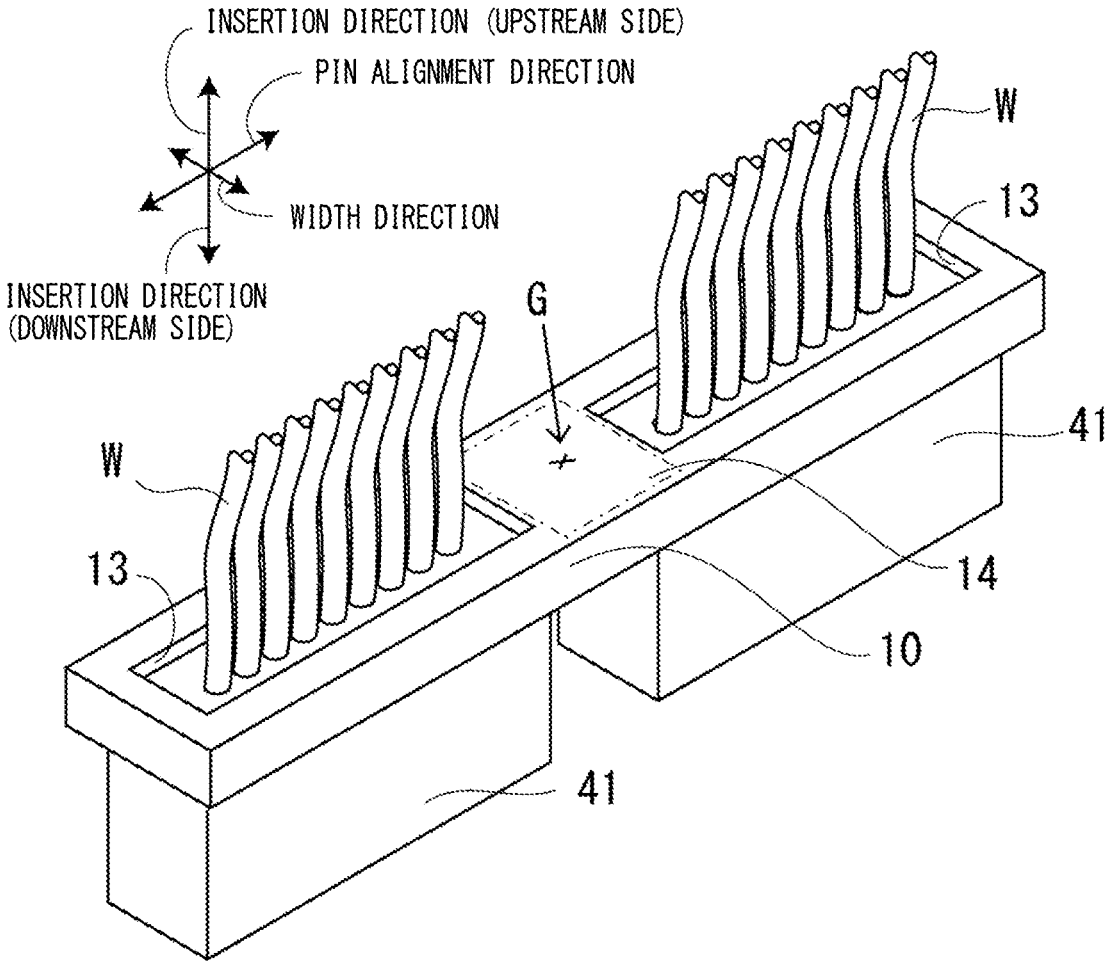
FIG. 1 is a perspective diagram showing a schematic configuration of a first embodiment of a connector holder of the present disclosure.
Figure 2A:
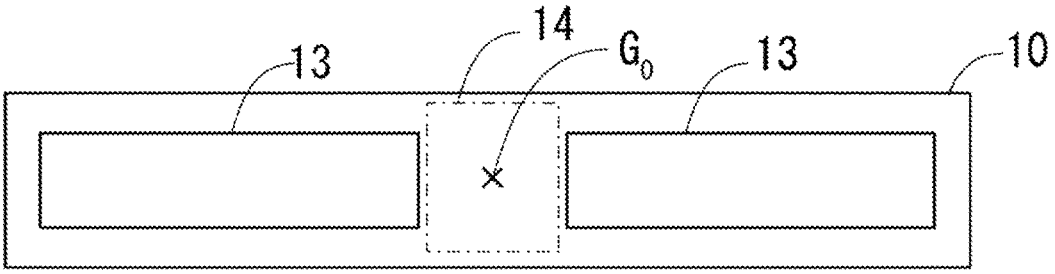
FIG. 2A is a top view of the connector holder shown in FIG. 1.
Figure 2B:
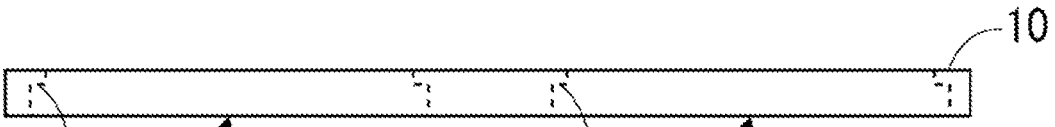
FIG. 2B is a side view of the connector holder shown in FIG. 1.
Figure 2C:
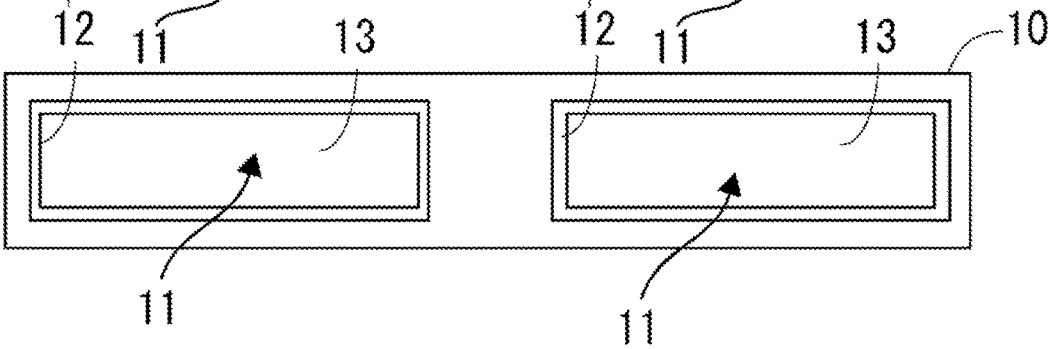
FIG. 2C is a bottom view of the connector holder shown in FIG. 1.

As shown in FIG. 1 to FIG. 2C, a connector holder 10 according to a first embodiment includes two holding portions 11 of the same shape (see FIG. 2B and FIG. 2C). The two holding portions 11 integrally hold two electric wire side connectors 41 of the same type respectively. The connector holder 10 is made of plastic (for example, acryl or polycarbonate) that has high hardness and high transparency. The electric wire side connectors 41 shown in FIG. 1 each have a 1-line 9-pin configuration, where nine electric wires W (see FIG. 1) are connected to each of the electric wire side connectors 41.

FIG. 2A is a top view of the connector holder 10 viewed from the upstream side in an insertion direction, FIG. 2B is a side view of the connector holder 10 viewed from a width direction that is perpendicular to the insertion direction and a pin alignment direction, and FIG. 2C is a bottom view of the connector holder 10 viewed from the downstream side in the insertion direction.

The holding portions 11 are each a fitting hole in which a wire-side end of an electric wire side connector 41 connected with the electric wires W is fitted from the downstream side in the insertion direction. The bottom of each of the holding portions 11 has a frame portion 12 and an opening 13, wherein the frame portion 12 is configured to abut on a peripheral edge of the wire-side end, and the electric wires W pass through the opening 13.

The holding portions 11 are arranged at a certain interval in a pin alignment direction of the electric wire side connectors 41 that are held thereby. A region of an upper surface of the connector holder 10 positioned between the holding portions 11 (a portion surrounded by a one-dot chain line in FIG. 1) is a pressed portion 14 that is formed as a plane perpendicular to the insertion direction. Here, the insertion direction is a direction in which the two electric wire side connectors 41 are respectively inserted into two board side connectors (not shown).

With the above-described configuration, it is possible to apply pressure force to the pressed portion 14 that is positioned between the electric wire side connectors 41 respectively held by the two holding portions 11 so that the two electric wire side connectors 41 can respectively be inserted into the two board side connectors (not shown) simultaneously. This improves the workability. It is noted that the configuration where the pressed portion 14 is formed as a plane perpendicular to the insertion direction makes it easy for a robot to apply the pressure force to insert the electric wire side connectors 41.

In addition, in a state where the connector holder 10 does not hold the electric wire side connectors 41, the weight distribution of the connector holder 10 is set such that the center of gravity $G_0$ in the pin arrangement direction is set as the center of the connector holder 10 in the pin arrangement direction, as shown in FIG. 2A. As a result, in a state where two holding portions 11 respectively hold two electric wire side connectors 41 of the same type, the center of the pressed portion 14 becomes the center of gravity G (an example of a center of gravity of the present disclosure, see FIG. 1) in the pin alignment direction. With this configuration, it is possible to cause the pressure force applied to the pressed portion 14 to act equally on the two electric wire side connectors 41 that are respectively held by the two holding portions 11.

Second Embodiment

Figure 3:
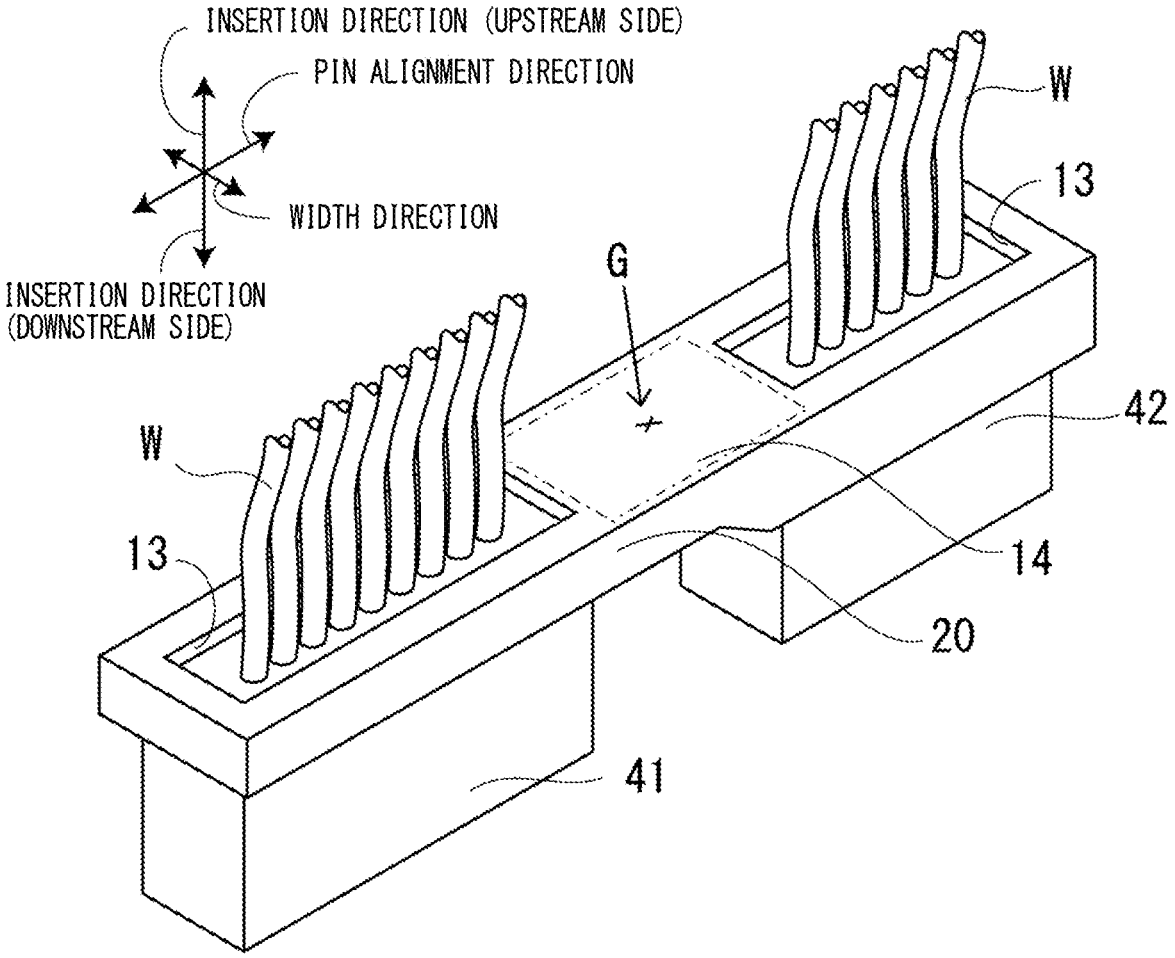
FIG. 3 is a perspective diagram showing a schematic configuration of a second embodiment of the connector holder of the present disclosure.
Figure 4A:
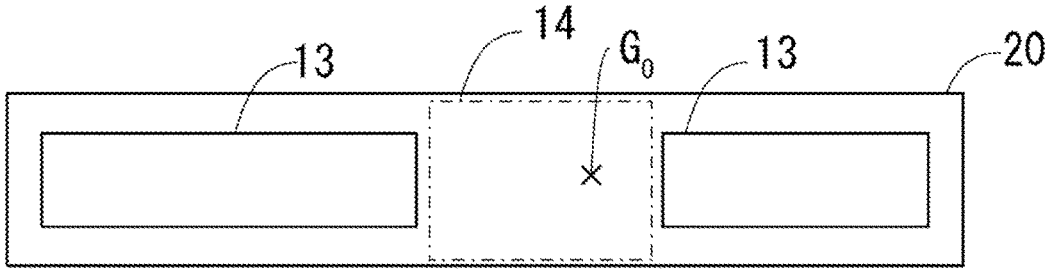
FIG. 4A is a top view of the connector holder shown in FIG. 3.
Figure 4B:
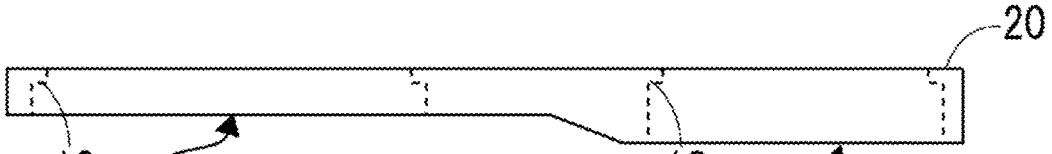
FIG. 4B is a side view of the connector holder shown in FIG. 3.
Figure 4C:
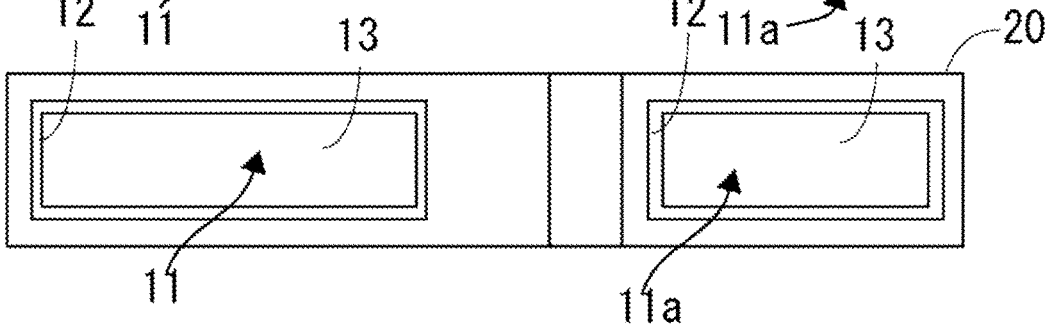
FIG. 4C is a bottom view of the connector holder shown in FIG. 3.

As shown in FIG. 3 to FIG. 4C, a connector holder 20 according to a second embodiment includes a holding portion 11 (see FIG. 4B and FIG. 4C) and a holding portion 11*a* (see FIG. 4B and FIG. 4C) that has a different shape from the holding portion 11. The holding portion 11 and the holding portion 11*a* integrally hold an electric wire side connector 41 and an electric wire side connector 42, respectively, wherein the electric wire side connector 42 has a different weight from the electric wire side connector 41. The connector holder 20 is made of plastic such as styrene or acryl that has high hardness. The electric wire side connector 42 shown in FIG. 3 has a 1-line 6-pin configuration, where six electric wires W are connected to the electric wire side connector 42. The electric wire side connector 42 is lighter than the electric wire side connector 41 that has the 1-line 9-pin configuration.

FIG. 4A is a top view of the connector holder 20 viewed from the upstream side in the insertion direction, FIG. 4B is a side view of the connector holder 20 viewed from the width direction that is perpendicular to the insertion direction and the pin alignment direction, and FIG. 4C is a bottom view of the connector holder 20 viewed from the downstream side in the insertion direction.

The holding portion 11 is a fitting hole in which a wire-side end of the electric wire side connector 41 connected with the electric wires W is fitted from the downstream side in the insertion direction. Similarly, the holding portion 11*a* is a fitting hole in which a wire-side end of the electric wire side connector 42 connected with the electric wires W is fitted from the downstream side in the insertion direction. The bottom of each of the holding portions 11 and 11*a* has the frame portion 12 and the opening 13, wherein the frame portion 12 is configured to abut on a peripheral edge of the wire-side end, and the electric wires W (see FIG. 3) pass through the opening 13.

The holding portions 11 and 11*a* are arranged at a certain interval in the pin alignment direction, and a region of an upper surface of the connector holder 20 positioned between the holding portions 11 and 11*a* (a portion surrounded by a one-dot chain line in FIG. 3) is the pressed portion 14 that is formed as a plane perpendicular to the insertion direction.

With the above-described configuration, it is possible to apply pressure force to the pressed portion 14 that is positioned between the electric wire side connector 41 held by the holding portion 11 and the electric wire side connector 42 held by the holding portion 11*a* so that the two electric wire side connectors 41 and 42 can respectively be inserted into two board side connectors (not shown) simultaneously. This improves the workability. It is noted that the configuration where the pressed portion 14 is formed as a plane perpendicular to the insertion direction makes it easy for a robot to apply the pressure force to insert the electric wire side connectors 41 and 42.

In addition, in a state where the connector holder 20 does not hold the electric wire side connectors 41 and 42, the weight distribution of the connector holder 20 is set such that the center of gravity $G_0$ in the pin arrangement direction is set as a position that has been displaced from the center of the connector holder 20 to be close to the holding portion 11*a* in the pin arrangement direction, as shown in FIG. 4A. As a result, in a state where the two holding portions 11 and 11*a* respectively hold the two electric wire side connectors 41 and 42, the center of the pressed portion 14 becomes the center of gravity G (an example of the center of gravity of the present disclosure, see FIG. 3) in the pin alignment direction. In other words, the weight distribution of the connector holder 20 is set such that the center of the pressed portion 14 becomes the center of gravity G in the pin alignment direction in the state where the holding portions 11 and 11*a* respectively hold the electric wire side connectors 41 and 42. With this configuration, it is possible to cause the pressure force applied to the pressed portion 14 to act equally on the electric wire side connector 41 and 42 respectively held by the holding portions 11 and 11*a*.

Third Embodiment

Figure 5:
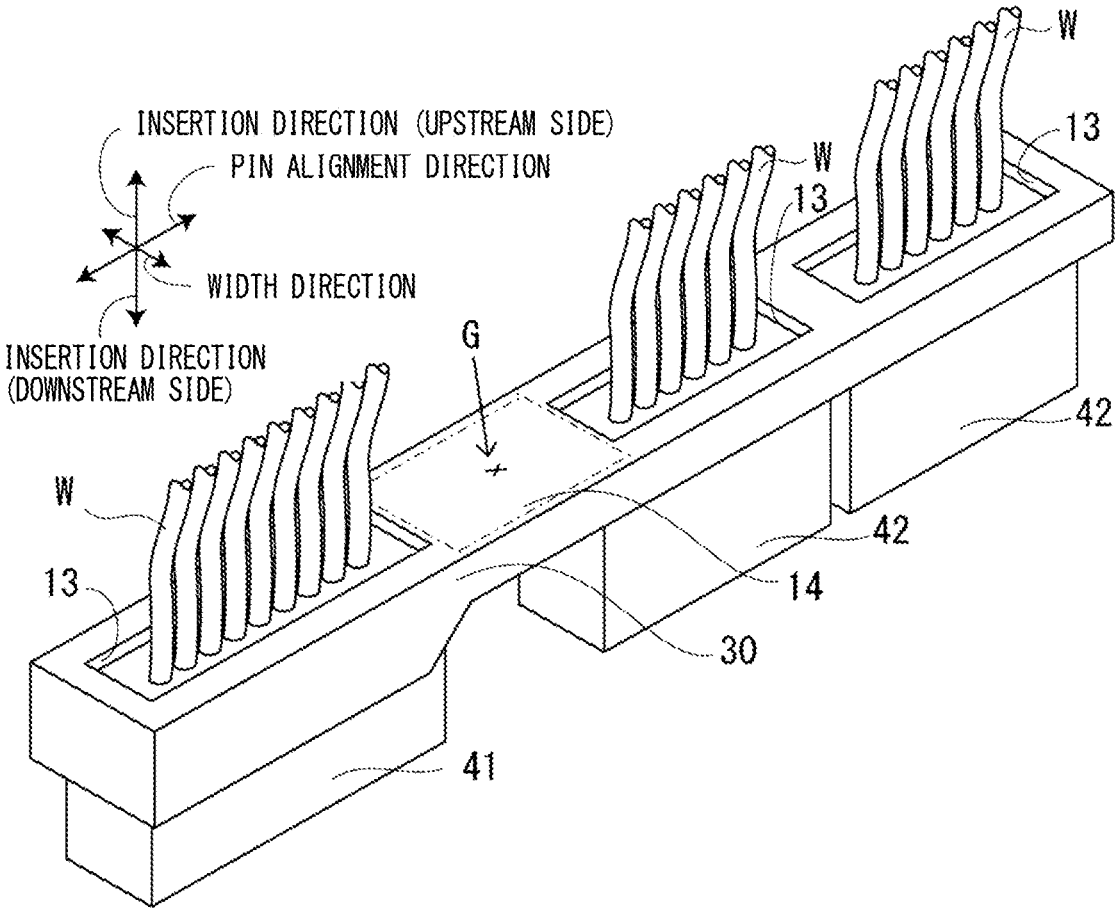
FIG. 5 is a perspective diagram showing a schematic configuration of a third embodiment of the connector holder of the present disclosure.
Figure 6A:
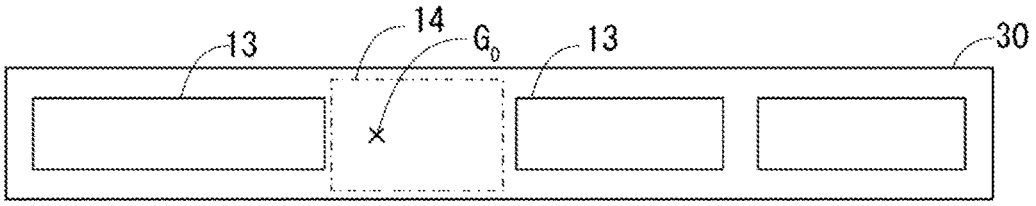
FIG. 6A is a top view of the connector holder shown in FIG. 5.
Figure 6B:
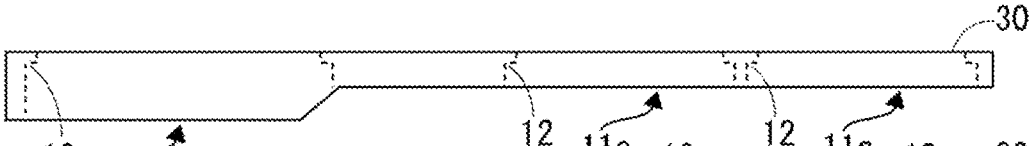
FIG. 6B is a side view of the connector holder shown in FIG. 5.
Figure 6C:
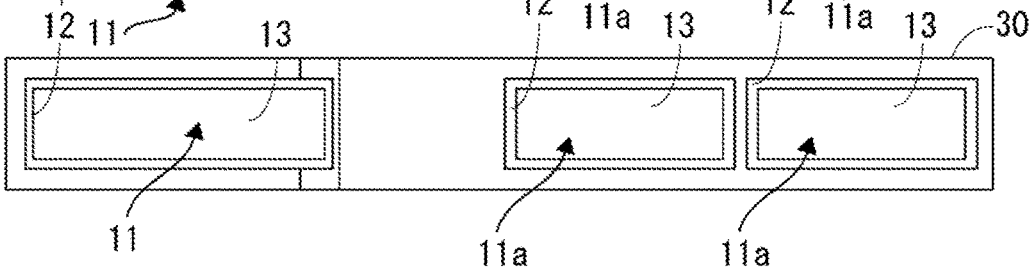
FIG. 6C is a bottom view of the connector holder shown in FIG. 5.

As shown in FIG. 5 to FIG. 6C, a connector holder 30 according to a third embodiment includes a holding portion 11 (see FIG. 6B and FIG. 6C) and two holding portions 11*a* (see FIG. 6B and FIG. 6C). The holding portion 11 and the two holding portions 11*a* integrally hold an electric wire side connector 41 and two electric wire side connectors 42, respectively. The connector holder 30 is made of plastic such as styrene or acryl that has high hardness.

FIG. 6A is a top view of the connector holder 30 viewed from the upstream side in the insertion direction, FIG. 6B is a side view of the connector holder 30 viewed from the width direction that is perpendicular to the insertion direction and the pin alignment direction, and FIG. 6C is a bottom view of the connector holder 30 viewed from the downstream side in the insertion direction.

The holding portion 11 and the two holding portions 11*a* are arranged at intervals in the pin alignment direction, and a region of an upper surface of the connector holder 30 positioned between the holding portion 11 and the two holding portions 11*a* (a portion surrounded by a one-dot chain line in FIG. 5) is the pressed portion 14 that is formed as a plane perpendicular to the insertion direction.

With the above-described configuration, it is possible to apply pressure force to the pressed portion 14 that is positioned between the electric wire side connector 41 held by the holding portion 11 and the two electric wire side connectors 42 held by the two holding portions 11*a* so that the three electric wire side connectors 41 and 42 can respectively be inserted into three board side connectors (not shown) simultaneously. This improves the workability. It is noted that the configuration where the pressed portion 14 is formed as a plane perpendicular to the insertion direction makes it easy for a robot to apply the pressure force to insert the three electric wire side connectors 41 and 42.

In addition, in a state where the connector holder 30 does not hold the electric wire side connectors 41 and 42, since the single electric wire side connector 41 is lighter than the two electric wire side connectors 42, the center of gravity $G_0$ in the pin arrangement direction is set as a position that has been displaced from the center of the connector holder 30 to be close to the holding portion 11 in the pin arrangement direction, as shown in FIG. 6A. As a result, in a state where the holding portions 11 and 11*a* respectively hold the electric wire side connectors 41 and 42, the center of the pressed portion 14 becomes the center of gravity G (an example of the center of gravity of the present disclosure, see FIG. 5) in the pin alignment direction. In other words, the weight distribution of the connector holder 30 is set such that the center of the pressed portion 14 becomes the center of gravity G in the pin alignment direction in the state where the holding portions 11 and 11*a* respectively hold the electric wire side connectors 41 and 42.

With the above-described configuration, it is possible to cause the pressure force applied to the pressed portion 14 to act equally on the electric wire side connectors 41 and 42 respectively held by the holding portions 11 and 11*a*.

Figure 7:
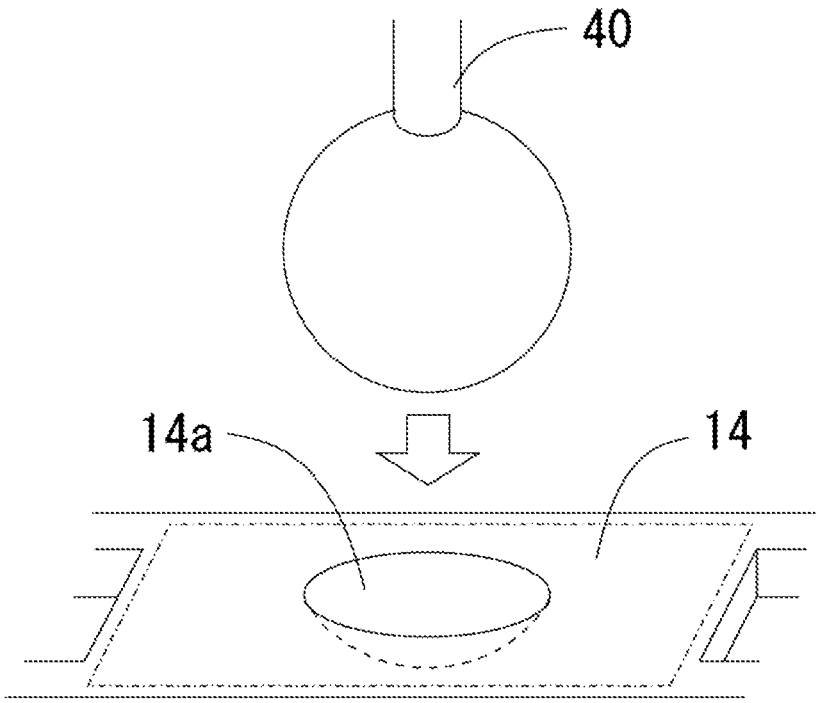
FIG. 7 is a diagram showing an example in which a dent is formed in a pressed portion shown in FIG. 1, FIG. 3, and FIG. 5.

In the above-described embodiments, the pressed portion 14 is formed as a plane. However, not limited to this, as shown in FIG. 7, a dent 14*a* may be formed at the center of the pressed portion 14. The dent 14*a* is formed in a shape that allows a tip of a robot hand 40 pressing the pressed portion 14 to be fitted therein. For example, as shown in FIG. 7, the tip of the robot hand 40 may be spherical. In that case, the dent 14*a* may be formed in the shape of a hemisphere or a spherical segment. With this configuration, even when the position of the robot hand 40 is slightly displaced, the tip of it is guided into the dent 14*a* by an outer peripheral edge and inner inclination of the dent 14*a*. As a result, this makes it possible for the robot hand 40 to press the pressed portion 14 at a correct position.

Not limited to the above-described configuration, four or more electric wire side connectors may be held by a connector holder. In addition, in the above-described embodiments, the electric wire side connectors 41 and 42 held by the connector holder each have one line of pins. However, not limited to this, each of electric wire side connectors held by the connector holder may have two or more lines of pins.

As described above, the embodiments of the present disclosure disclose connector holders 10, 20, and 30 that each integrally holds a plurality of electric wire side connectors 41 and 42. The connector holder includes a plurality of holding portions 11 and 11*a* which are formed in a lower surface side of the connector holder, and in which a plurality of wire-side ends of the plurality of electric wire side connectors 41 and 42 are respectively fitted. The plurality of holding portions 11 and 11*a* are arranged at intervals in a pin alignment direction in which a plurality of pins are aligned in each of the plurality of electric wire side connectors 41 and 42 held by the plurality of holding portions 11 and 11*a*. A part of an upper surface of the connector holder that is positioned between the plurality of holding portions 11 and 11*a* is a pressed portion 14 that is formed as a plane perpendicular to the insertion direction.

When a multipole electric wire side connector is fitted in a board side connector, pressure force is required. However, conventional techniques have a following problem. That is, since the electric wire(s) is present at the center of the connector, the pressure force is applied to a side portion of the connector, providing only insufficient force. This problem could be solved if a connector of a special specification was used, the connector having a space at its center so that pressure force can be applied thereto. In that case, however, the connector would be expensive. In addition, general-purpose connectors cannot be used.

On the other hand, each of the connector holders 10, 20, and 30 according to the embodiments of the present disclosure having the above-described configuration can integrally hold the plurality of electric wire side connectors 41 and 42 in a state where the pressed portion 14 is secured as the space to which the pressure force is applied.

Furthermore, the embodiments of the present disclosure disclose that the connector holder includes two holding portions 11 that respectively hold two electric wire side connectors 41 of a same type, and a center of the pressed portion 14 is a center of gravity G in the pin alignment direction.

With this configuration, it is possible to cause the pressure force applied to the pressed portion 14 to act equally on the two electric wire side connectors 41 that are respectively held by the two holding portions 11.

Furthermore, the embodiments of the present disclosure disclose that the connector holder includes a first holding portion (the holding portion 11) and a second holding portion (the holding portion 11*a*), the first holding portion holding a first electric wire side connector (the electric wire side connector 41), the second holding portion holding a second electric wire side connector (the electric wire side connector 42) that has a different weight from the first electric wire side connector.

With this configuration, the connector holder can integrally hold electric wire side connectors of different types.

Furthermore, the embodiments of the present disclosure disclose that a weight distribution of the connector holder is set such that the center of the pressed portion 14 becomes the center of gravity G in the pin alignment direction in a state where the first holding portion (the holding portion 11) holds the first electric wire side connector (the electric wire side connector 41), and the second holding portion (the holding portion 11*a*) holds the second electric wire side connector (the electric wire side connector 42).

With this configuration, it is possible to cause the pressure force applied to the pressed portion 14 to act equally on the electric wire side connectors 41 and 42 that are respectively held by the holding portions 11 and 11*a*.

Furthermore, the embodiments of the present disclosure disclose that the connector holder includes three or more holding portions 11, 11*a* that respectively hold three or more electric wire side connectors 41, 42, and a weight distribution of the connector holder is set such that the center of the pressed portion 14 becomes the center of gravity G in the pin alignment direction in a state where the three or more holding portions 11, 11*a* respectively hold the three or more electric wire side connectors 41, 42.

With this configuration, it is possible to cause the pressure force applied to the pressed portion 14 to act equally on the three or more electric wire side connectors 41, 42 that are respectively held by the three or more holding portions 11, 11*a*.

Furthermore, the embodiments of the present disclosure disclose that the weight distribution of the connector holder is set such that the center of the pressed portion becomes the center of gravity G in the pin alignment direction, based on thickness in the insertion direction.

With this configuration, it is possible to set the weight distribution easily.

Furthermore, the embodiments of the present disclosure disclose that a dent 14*a* is formed in the pressed portion 14 such that a tip of a robot hand 40 pressing the pressed portion 14 is fitted in the dent 14*a*.

With this configuration, even when the position of the robot hand 40 is slightly displaced, the tip of it is guided into the dent 14*a* by the inclination thereof. As a result, this makes it possible for the robot hand 40 to press the pressed portion 14 at a correct position.

It is to be understood that the present disclosure is not limited to the above-described embodiments, and the embodiments can be changed as appropriate within a scope of technical idea of the present disclosure. In addition, the number, positions, shapes and the like of the above-described components are not limited to those disclosed in the embodiments, but may be set as those suitable for the implementation of the present disclosure. It is noted that in the drawings, common components are assigned the same reference signs.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A connector holder for integrally holding a plurality of electric wire side connectors, the connector holder comprising:

a plurality of holding portions which are formed in a lower surface side of the connector holder, and in which a plurality of wire-side ends of the plurality of electric wire side connectors are respectively fitted, wherein the plurality of holding portions are arranged at intervals in a pin alignment direction in which a plurality of pins are aligned in each of the plurality of electric wire side connectors held by the plurality of holding portions, a part of an upper surface of the connector holder that is positioned between the plurality of holding portions is a pressed portion that is pressed so that the plurality of electric wire side connectors are inserted in a predetermined insertion direction, the pressed portion is formed as a plane perpendicular to the insertion direction, the plurality of holding portions are composed of a first holding portion and a second holding portion, the first holding portion holding a first electric wire side connector, the second holding portion holding a second electric wire side connector that has a different weight from the first electric wire side connector, and a weight distribution of the connector holder is set such that a center of the pressed portion becomes a center of gravity in the pin alignment direction in a state where the first holding portion holds the first electric wire side connector, and the second holding portion holds the second electric wire side connector.

2. The connector holder according to claim 1, wherein the first and second electric wire side connectors are of a same type.

3. The connector holder according to claim 1, wherein the weight distribution of the connector holder is set such that the center of the pressed portion becomes the center of gravity in the pin alignment direction, based on thickness in the insertion direction.

4. The connector holder according to claim 1, wherein a dent is formed in the pressed portion such that a tip of a robot hand pressing the pressed portion is fitted in the dent.

* * * * *